US008808148B2

(12) United States Patent
Watterson et al.

(10) Patent No.: US 8,808,148 B2
(45) Date of Patent: Aug. 19, 2014

(54) ELLIPTICAL EXERCISE MACHINE WITH DECLINING ADJUSTABLE RAMP

(75) Inventors: Scott Watterson, Logan, UT (US); William Dalebout, North Logan, UT (US); Keith Taylor, Plain City, UT (US); Robert Alleman, North Logan, UT (US)

(73) Assignee: Icon IP, Inc., Logan, UT (US)

( * ) Notice: Subject to any disclaimer, the term of this patent is extended or adjusted under 35 U.S.C. 154(b) by 582 days.

(21) Appl. No.: 13/086,674

(22) Filed: Apr. 14, 2011

(65) Prior Publication Data

US 2012/0190508 A1 Jul. 26, 2012

Related U.S. Application Data

(60) Provisional application No. 61/435,182, filed on Jan. 21, 2011.

(51) Int. Cl.

| | |
|---|---|
| ***A63B 22/00*** | (2006.01) |
| *A63B 22/06* | (2006.01) |
| *A63B 21/22* | (2006.01) |
| *A63B 71/06* | (2006.01) |

(52) U.S. Cl.

CPC ..... *A63B 22/001* (2013.01); *A63B 2022/0676* (2013.01); *A63B 21/225* (2013.01); *A63B 22/0664* (2013.01); *A63B 22/0023* (2013.01); *A63B 71/0622* (2013.01)

USPC ..... 482/51; 482/52; 482/71

(58) Field of Classification Search

USPC ..... 482/52, 57, 51, 54, 72, 74

See application file for complete search history.

(56) References Cited

U.S. PATENT DOCUMENTS

| | | | | |
|---|---|---|---|---|
| 6,361,476 | B1 * | 3/2002 | Eschenbach | 482/52 |
| 7,267,638 | B2 * | 9/2007 | Wang | 482/52 |
| 2007/0238580 | A1 * | 10/2007 | Wang | 482/52 |

* cited by examiner

*Primary Examiner* — Jerome W Donnelly
(74) *Attorney, Agent, or Firm* — Holland & Hart LLP

(57) ABSTRACT

An elliptical exercise machine includes a base support structure adapted to be positioned on a support surface. The machine includes first and second reciprocating foot supports, each foot support being movably linked to the base support structure. Additionally, a ramp assembly is situated on the base support structure, the ramp assembly having first and second guide rails for guiding the respective second ends of the first and second foot supports such that the foot supports move in an elliptical path when the elliptical exercise machine is operating. Moreover, a first support member is linked to the base support structure, wherein the first support member is pivotably linked to the ramp assembly at a point above the base support structure. Furthermore, a lift mechanism is linked on a first end to the base support structure and pivotably linked on a second end to the ramp assembly above the base support structure.

20 Claims, 13 Drawing Sheets

ELLIPTICAL EXERCISE MACHINE WITH DECLINING ADJUSTABLE RAMP

RELATED APPLICATION

The present application claims priority under 35 U.S.C. §119(e) from the following previously-filed Provisional Patent Application, U.S. Application No. 61/435,182, filed Jan. 21, 2011, entitled "Elliptical Exercise Machine With Declining Adjustable Ramp," and which is incorporated herein by reference in its entirety.

BACKGROUND

Exercise machines having alternating reciprocating foot supports configured to traverse or travel about a closed path to simulate a striding, running, walking, and/or a climbing motion for the individual using the machine are well known, and are commonly referred to as elliptical exercise machines or elliptical cross-trainers. In general, an elliptical or elliptical-type exercise machine comprises a pair of reciprocating foot supports designed to receive and support the feet of a user. Each reciprocating foot support has at least one end supported for rotational motion about a pivot point, with the other end supported in a manner configured to cause the reciprocating foot support to travel or traverse a closed path, such as a reciprocating elliptical or oblong path or other similar geometric outline. Therefore, upon operation of the exercise machine, each reciprocating foot support is caused to travel or traverse the closed path, thereby simulating a striding motion of the user for exercise purposes. Typically, the reciprocating foot supports are configured to be out of phase with one another by approximately 180 degrees in order to simulate a proper and natural alternating stride motion.

An individual may utilize an elliptical exercise machine by placing his or her feet onto the reciprocating foot supports. Once standing on the foot supports, the individual may then actuate the exercise machine for any desired length of time and at any desired pace to cause the reciprocating foot supports to repeatedly travel their respective closed paths, which action effectively results in a series of strides achieved by the individual to obtain a desired level of exercise, such as distance travelled or calories burned. Exercise achieved using an elliptical exercise machine is particularly favored by individuals seeking aerobic exercise that causes little or no physical impact.

In a training environment, those exercising on equipment for strength training and/or muscle toning are in constant need of motivation or encouragement by coaches, trainers, or goal measuring systems. Some individuals, particularly those with sufficient resources, hirer personal coaches or fitness trainers to do just that. A personal trainer will follow a trainee through a workout, showing the trainee which exercises to perform to build or tone certain areas of one's body, how to perform those exercises or any exercise desired, and provide motivation along the way.

One type of elliptical exercise machine is disclosed in U.S. Pat. No. 7,618,350 issued to William T. Dalebout et al. and assigned to Icon IP, Inc. In this patent, an elliptical exercise machine includes a ramp assembly that is adjustably linked to the frame by an adjustment mechanism disposed on the front of the ramp assembly. The adjustment mechanism is actuated to adjust the position of the ramp assembly and to thereby adjust the stride movements of the respective foot placement pads associated therewith. Similar elliptical exercise machines can also be found in U.S. Pat. Nos. 5,242,242; 5,282,829; and 5,685,804.

SUMMARY

In one aspect of the disclosure, an elliptical exercise machine includes a base support structure adapted to be positioned on a support surface.

Another aspect of the disclosure may include any combination of the above-mentioned features and may further include an upright support structure extending upward from a front portion of the base support structure.

Another aspect of the disclosure may include any combination of the above-mentioned features and may further include first and second reciprocating foot supports, each foot support having a first end and a second end, the first end of each foot support being movably linked to a base support structure.

Another aspect of the disclosure may include any combination of the above-mentioned features and may further include a drive assembly situated on the front portion of the base support structure, the first end of each foot support being attached to the drive assembly such that the first end of each foot support is movably linked to the base support structure.

Another aspect of the disclosure may include any combination of the above-mentioned features and may further include first and second swing arms, each arm having an upper portion and a lower portion, the upper portion of each arm being pivotally connected to the upright support structure, the lower portion of each arm being interconnected to the respective first and second foot supports.

Another aspect of the disclosure may include any combination of the above-mentioned features and may further include first and second link arms, each link arm having a first end and a second end, wherein the lower portion of each swing arm is pivotally connected to the first end of each respective link arm and the second end of each respective link arm is connected to the respective first and second foot supports, wherein each swing arm is pivotally connected to the first end of each respective link arm at the lower end of the lower portion of each swing arm.

Another aspect of the disclosure may include any combination of the above-mentioned features and may further include a ramp assembly situated on the base support structure, the ramp assembly having first and second guide rails for guiding the respective second ends of the first and second foot supports such that the foot supports are moveable in an elliptical path.

Another aspect of the disclosure may include any combination of the above-mentioned features and may further include a first support member supported by the base support structure, wherein the first support member is pivotably attached to the ramp assembly at a point above the base support structure.

Another aspect of the disclosure may include any combination of the above-mentioned features and may further exhibit a Taylor factor between 0 and 2.

Another aspect of the disclosure may include any combination of the above-mentioned features and may further exhibit a Taylor factor between 0 and 1.2.

Another aspect of the disclosure may include any combination of the above-mentioned features and may further include the first support member is pivotably attached to the ramp assembly at a point in a central region of the ramp assembly.

Another aspect of the disclosure may include any combination of the above-mentioned features and may further include the first support member being a fulcrum member.

Another aspect of the disclosure may include any combination of the above-mentioned features and may further include a lift mechanism attached on a first end to the base support structure and attached on a second end to the ramp assembly.

Another aspect of the disclosure may include any combination of the above-mentioned features and may further include the lift mechanism attached to the ramp assembly above the base support structure.

Another aspect of the disclosure may include any combination of the above-mentioned features and may further include a lift mechanism is positionable in both a low and a high orientation, wherein the low orientation of the lift mechanism creates a connection point on the ramp assembly that is lower than a height of the fulcrum member and the high orientation of the lift mechanism creates a connection point that is higher than a height of the fulcrum member.

Another aspect of the disclosure may include any combination of the above-mentioned features and may further include a lift mechanism and a first support member that are configured to selectively orient the ramp assembly in a positive angular orientation of at least +20 degrees relative to horizontal and a negative angular orientation of at least −10 degrees relative to horizontal.

Another aspect of the disclosure may include any combination of the above-mentioned features and may further include the lift mechanism and the first support member each being linear actuators.

BRIEF DESCRIPTION OF THE DRAWINGS

The accompanying drawings illustrate various embodiments of the present method and system and are a part of the specification. The illustrated embodiments are merely examples of the present system and method and do not limit the scope thereof.

Throughout the drawings, identical reference numbers designate similar, but not necessarily identical, elements.

DETAILED DESCRIPTION

Figure 1:
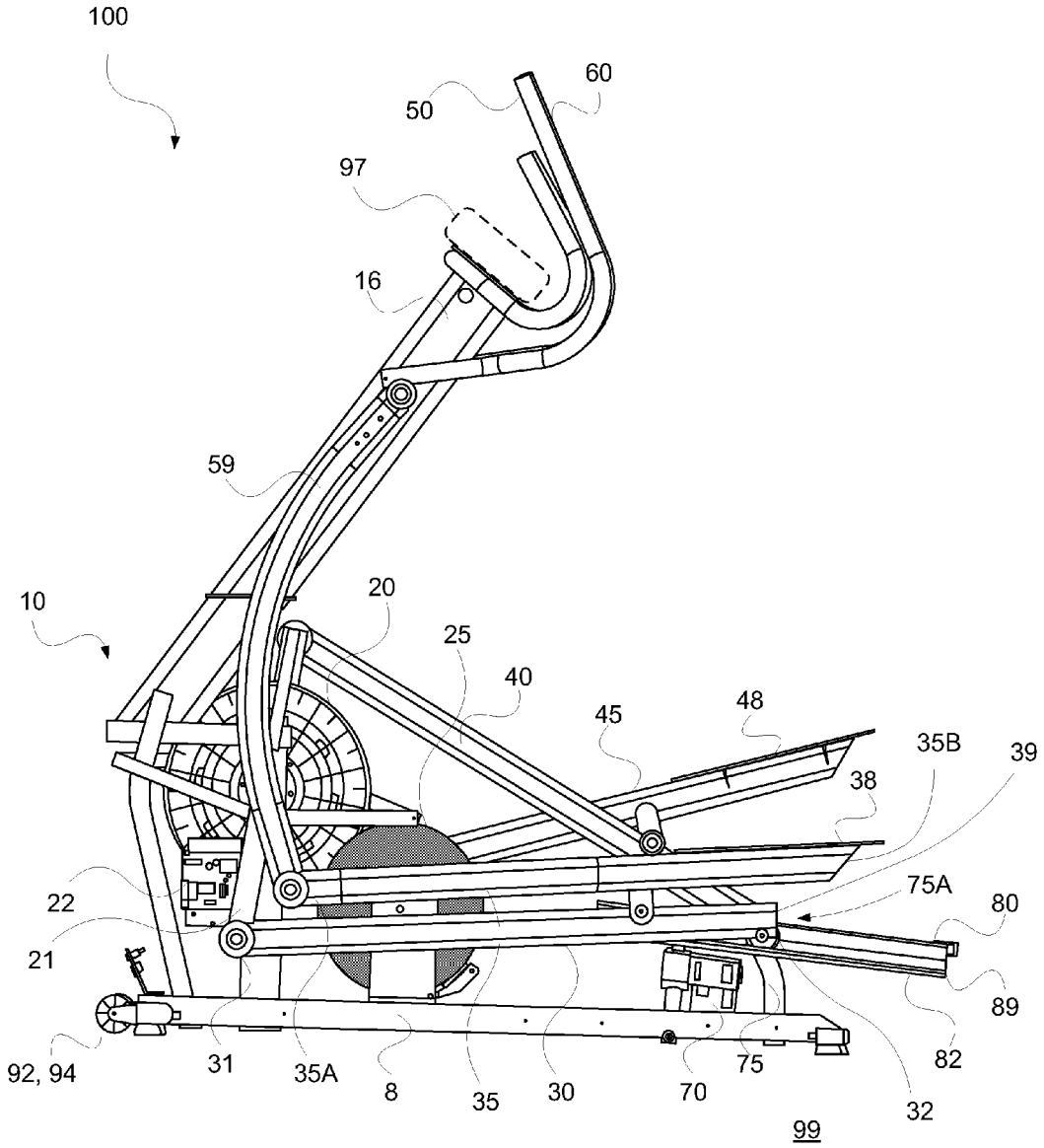
FIG. 1 illustrates a side view of a front mechanical-type elliptical exercise machine according to one embodiment.

An adjustable elliptical exercise machine including an inclining and declining ramp is disclosed herein. Specifically, the present system provides an elliptical exercise machine having a ramp assembly to which is linked foot placement pads and reciprocating foot supports. The ramp assembly is configured to support and guide the reciprocating foot supports according to various selective and dynamically achievable positive and negative angles relative to the base frame of the exercise apparatus. According to one embodiment, the ramp assembly is supported at two points by support structures or members, the support points being above the base frame. According to this embodiment, the ramp assembly is supported at a first point by the fulcrum member and at a second point by a lift mechanism such as a linear or non-linear actuator. Actuation of the lift mechanism imparts a force on the portion of the ramp assembly supported by the lift mechanism and causes the ramp assembly to rotate about the fulcrum member, thereby causing the ramp assembly to selectively and predictably assume controlled positions. By rotatably coupling the ramp assembly in the central region and coupling the lift mechanism to a second portion of the ramp assembly, the ramp assembly can be oriented in a horizontal orientation, a positively angled orientation, and a negatively angled orientation, relative to the base. A number of structures and methods of the present elliptical exercise machine are described in detail below.

As used herein, and in the appended claims, the term "lift mechanism" shall be interpreted broadly as including any number of linear or non-linear actuators or other positioning apparatuses including, but in no way limited to a lead screw motor, a hydraulic actuator, a worm gear actuator, a manual actuator, a pneumatic actuator, and the like.

As used herein, the term "central region" shall be interpreted broadly, both here and in the appended claims as including any region of an object, such as a substantially planar ramp, having a length "L" that is greater than 0.20*L from an endpoint of length "L" but less than 0.80*L from the same endpoint.

As used herein and in the appended claims, the term "Taylor factor" shall be interpreted according to the following formula:

$$\text{Taylor factor}=(H/L)/(\text{ARCTAN}\ (H/P)),$$

wherein:

H=Height of Ramp Pivot from the floor

L=Length of Ramp

P=Horizontal Distance from Front of Ramp to the Pivot

As used herein, the term "lever" shall be interpreted broadly both here and in the appended claims as including any substantially rigid object configured to pivot about a fixed point located in the central region of the rigid object.

As used herein, the term "fulcrum member" shall be interpreted broadly both here and in the appended claims as any member exerting a force on a point of a substantially rigid object, wherein the point forms the pivot about which a lever turns.

The present specification describes and features an exercise machine, and more particularly an elliptical or elliptical-type exercise machine that allows the user to easily and readily adjust the level of resistance experienced by a user during operation. According to one embodiment, the elliptical-type exercise machine has a Taylor factor between 0 and 2 and can modify the position of the ramp between approximately −15 degrees to approximately +25 degrees relative to horizontal. In other embodiments, the elliptical-type exercise machine has a Taylor factor between approximately 0.5 and 2, between approximately 0.1 and 1.9, between approximately 0.2 and 1.6, or between 0.3 and 1.2.

Particularly, with reference to the Figures, FIG. 1 shows a side view of a front mechanical-type elliptical exercise device 100 according to the present system and method. The elliptical exercise device 100 includes a frame 10, a drive assembly 20, a ramp assembly 80, a lift mechanism 70 and a fulcrum member 75 supporting to the ramp assembly 80, a first reciprocating foot support 30 attached to the drive assembly, a second reciprocating foot support 40 attached to the drive assembly, and first and second swing arms 50 and 60 pivotally associated with the frame 10. The frame 10 comprises a base support structure 8 and an upright support structure 16, about which the swing arms 50 and 60 pivot.

The elliptical exercise device 100 further includes first and second link arms 35 and 45 and first and second foot placement pads 38 and 48. With respect to the first side of the elliptical exercise machine 100, the first swing arm 50 has a lower end 59 that is connected to the forward end 35A of the first link arm 35. The rearward end 35B of the first link arm 35 is then connected to the first reciprocating foot support 30. The rearward end 35B of the link arm 35 is connected to and supports the first foot placement pad 38. The forward end 31 of the first reciprocating foot support 30 is connected to a first crank 21 of the drive assembly 20, while the rearward end 39 of the first reciprocating foot support 30 has a first roller wheel 32, which rides back and forth on a first guide rail 82 of the ramp assembly 80. The respective parts of the second side of the elliptical exercise machine 100 are connected in the same manner as the right side, except that the sides are offset by approximately 180 degrees relative to the parts on the first side of the elliptical exercise machine.

As illustrated in FIG. 1, the lift mechanism 70 is mounted on top of the base support structure 8 and connects with the ramp assembly 80 on, according to one embodiment, the bottom surface of the ramp assembly 80. As further illustrated in FIGS. 1-3, the fulcrum member 75 is also mounted on the rear portion of the base support structure 8 and extends upwards therefrom and pivotably engages the ramp assembly 80 in the central region thereof. As illustrated in FIG. 1, the lift mechanism 70 is selectively actuated to a position that the ramp assembly 80 is between 0 and +5 degrees relative to horizontal.

Figure 2:
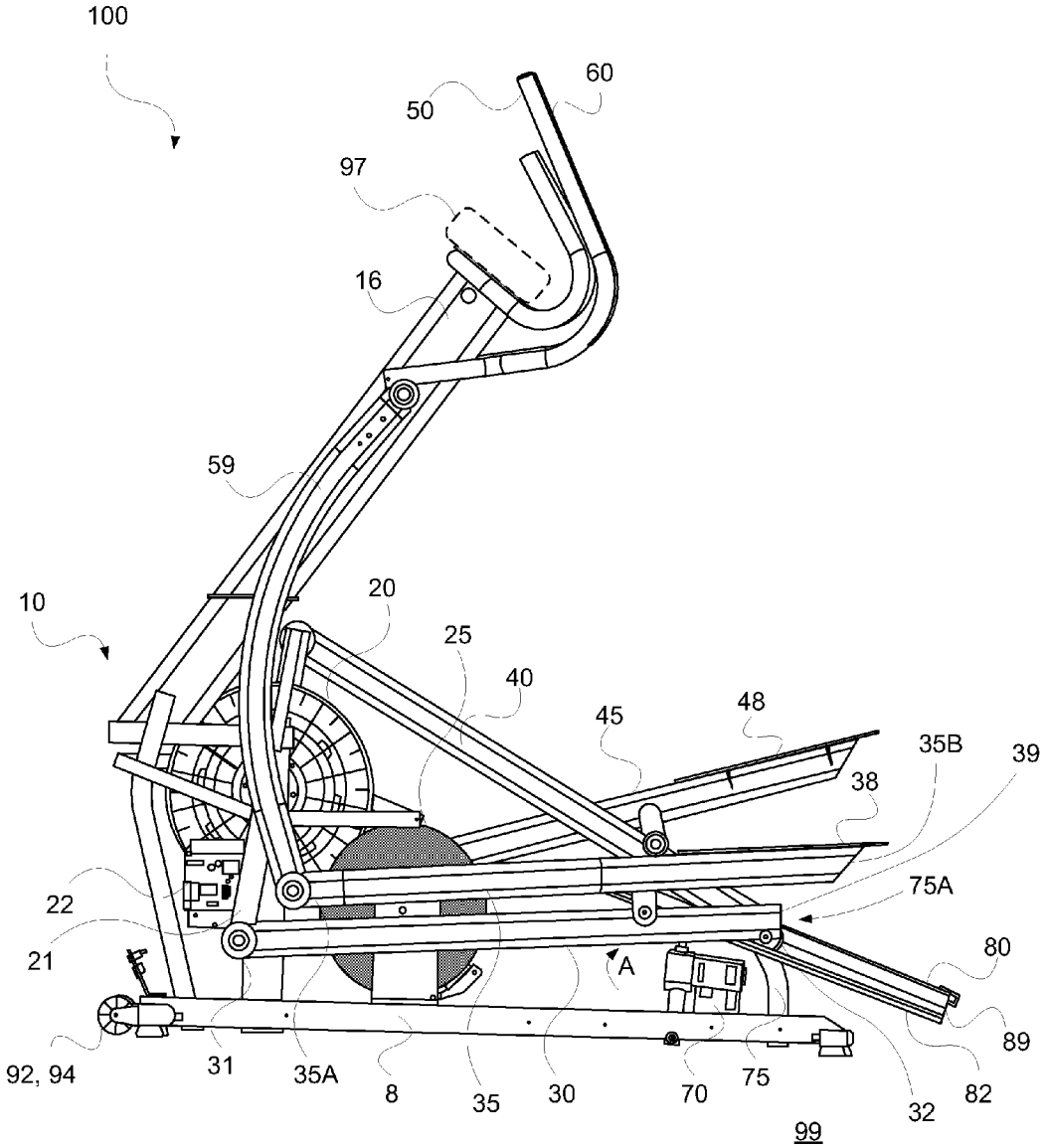
FIG. 2 illustrates another side view of the elliptical exercise machine of FIG. 1 in an inclined position, according to one embodiment.

FIG. 2 shows another side view of the elliptical exercise machine 100 of FIG. 1. Specifically, FIG. 2 illustrates the exercise machine 100 with the ramp assembly 80 in a positive angular position relative to horizontal. According to one embodiment, the ramp assembly 80 in its highest positive angular position may assume a position at least positive 20 degrees relative to horizontal, including potentially positive 25 degrees relative to horizontal. Alternatively, the dimensions of the lift mechanism and the fulcrum member may be modified to increase the maximum positive angular position to thirty degrees or more. To elevate the ramp assembly 80, the lift mechanism 70 raises the ramp assembly 80, which pivots about fulcrum pivot point 75A in the direction of arrow A and thereby raises the ramp 80 in a positive angular direction relative to the horizontal support surface 99. According to this embodiment, actuation of the lift mechanism 70 causes the ramp assembly 80 to act as a lever about the fulcrum pivot point 75A. With two points of contact on the ramp 80, neither of which is at an end of the ramp or on the base support structure 8, the ramp assembly is fully supported and has sufficient structural integrity to support the dynamic forces exerted thereon by a user operating the elliptical exercise machine 100.

Figure 3:
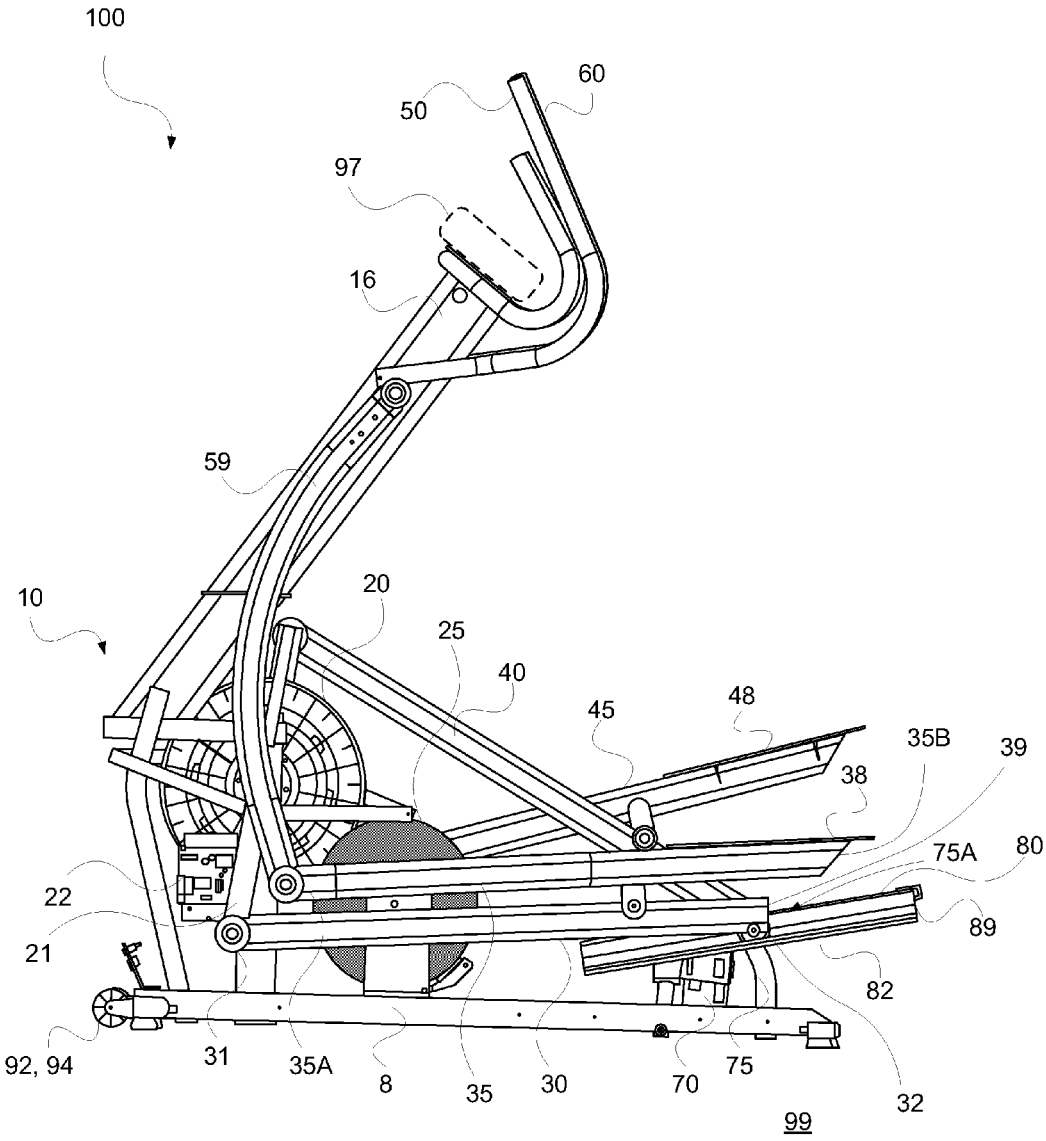
FIG. 3 illustrates another side view of the elliptical exercise machine of FIG. 1 in a decline position, according to one embodiment.

Further, FIG. 3 illustrates a side view of the elliptical exercise machine 100 of FIG. 1 in a declined position wherein the ramp is maintained at a negative angular position relative to horizontal. Specifically, by coupling the ramp assembly 80 at or near the center portion thereof, with an elevated fulcrum member 75, there is sufficient space for the lift mechanism 70 to fully retract, causing the ramp assembly 80 to rotate about the pivot point 75A such that the ramp assembly passes below horizontal and assumes a negative angular position, relative to the horizontal support surface 99. According to one embodiment, the present configuration will allow the ramp assembly to be positioned at a negative angular orientation between 0 and −15 degrees, or according to another embodiment, between 0 and −10 degrees relative to the horizontal support surface 99, while in others, between 0 and −5 degrees relative to the horizontal support surface 99. As illustrated in FIG. 3, the negative angular position of the ramp assembly will modify both the path and resistance provided as the foot placement pads 38, 48 are actuated by a user.

Signals for raising or lowering the ramp, i.e., signals for increasing or decreasing the level of difficulty of exercise, are sent to the lift mechanism 70 from a console 97 disposed on an upright structure 16 forming part of the frame 10. According to one embodiment, the console 97 may include any number of electronic computing devices including a processor configured to provide the user with motivation, feedback, and/or entertainment while exercising. According to one embodiment, the signals for adjusting the angle of the ramp assembly 80 are sent from the controller 97 to a circuit board 22 and to the lift mechanism 70 by wires. Alternatively, the console 97 may contain the functionality to transmit the commands to the lift mechanism 70 wirelessly.

Figure 11:
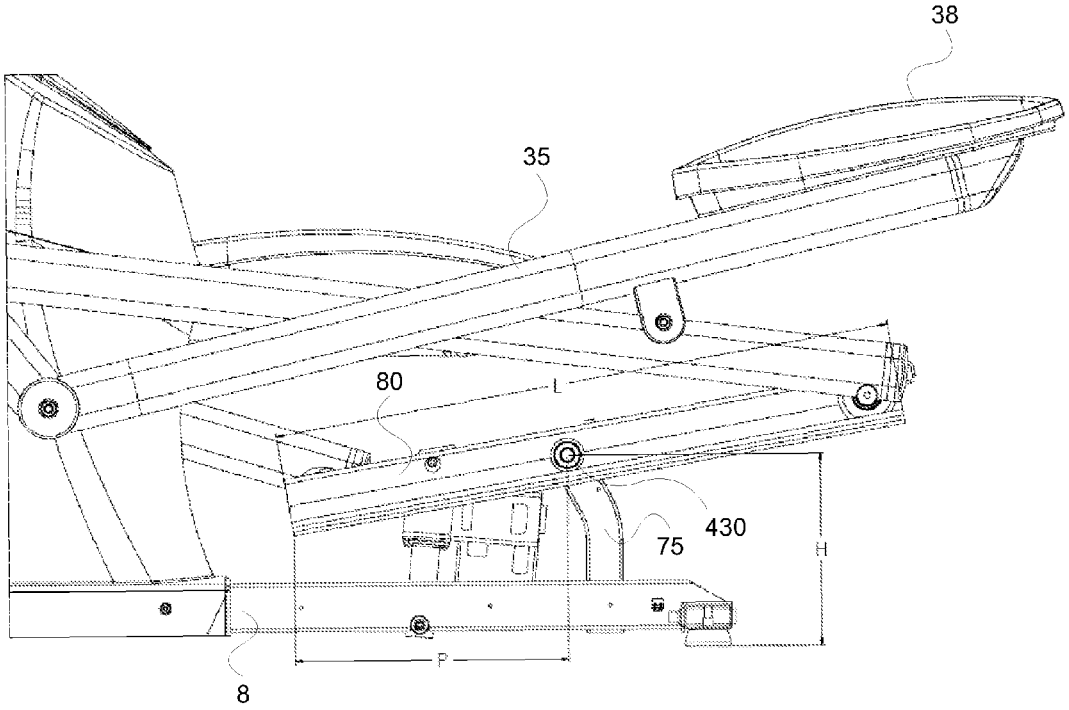
FIG. 11 illustrates a side view of the elliptical exercise machine of FIG. 1, depicting the area around the lift adjustment mechanism, according to one embodiment.

According to one embodiment, the ability of the ramp assembly 80 of the elliptical exercise machine 100 to assume a negative angular position, relative to the horizontal support surface 99 is exemplified by a ramp assembly, such as that illustrated in FIG. 11 having a Taylor factor between at least 0 and 2, and in some configurations having a Taylor factor between 0 and 1.2. According to the configuration illustrated in FIG. 11, L represents the length of the ramp assembly 80, H represents the height of the rod reception feature 430 or ramp pivot from the floor and P represents the horizontal distance from the front of the ramp assembly 80 to the rod reception feature 430 or ramp pivot. As noted above, an elliptical exercise machine including a ramp assembly 80 having a Taylor factor between at least 0 and 2, and in some configurations, a Taylor factor between 0 and 1.2, between approximately 0.5 and 2, between approximately 0.1 and 1.9, between approximately 0.2 and 1.6, or between 0.3 and 1.2 can be configured to be positioned at an appropriate negative angular orientation relative to the horizontal support surface 99.

Figure 4:
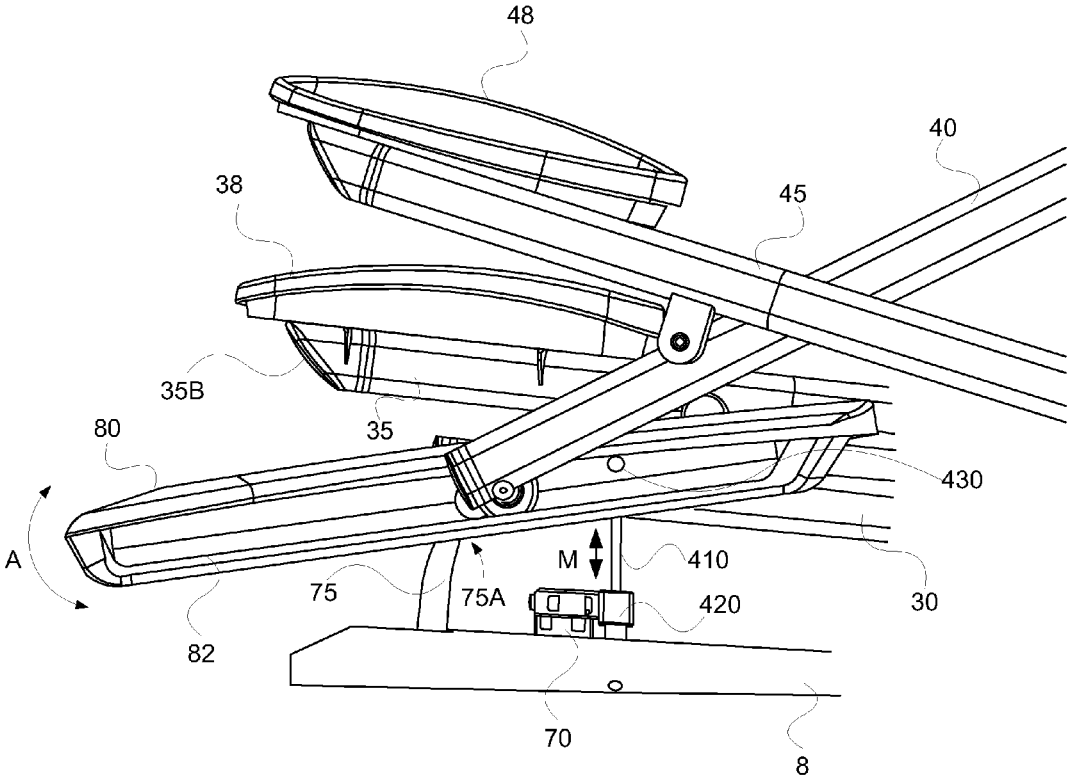
FIG. 4 illustrates an enlarged, side view of the elliptical exercise machine of FIG. 1, depicting the area around the lift adjustment mechanism, according to one embodiment.
Figure 5:
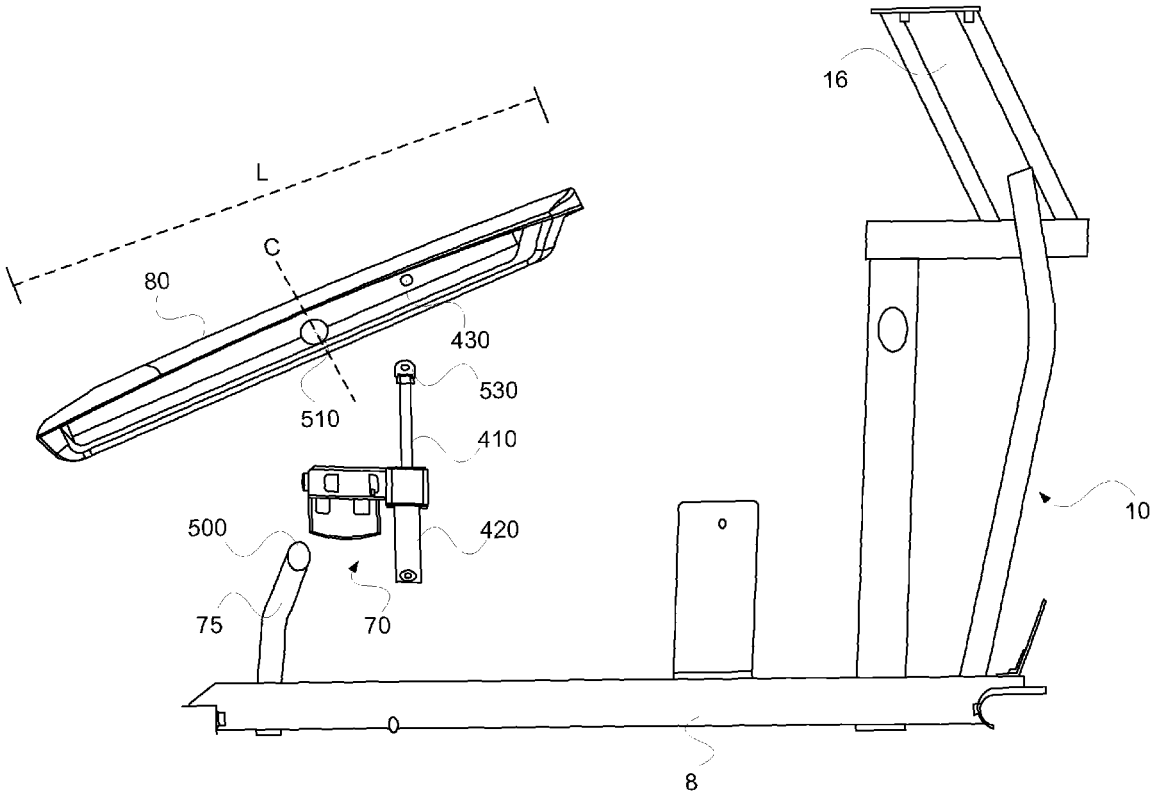
FIG. 5 illustrates an exploded perspective view of the lift adjustment mechanism of the exercise machine of FIG. 1, according to one embodiment.

Actuation of the ramp assembly 80 is more easily seen in FIGS. 4 and 5. FIG. 4 illustrates an enlarged, cut-away perspective view of the elliptical machine of FIG. 1, detailing the area around the lift mechanism 70 and the fulcrum member 75. Together, the lift mechanism 70 and the fulcrum member 75 comprise an adjustment mechanism of the present system and method that allows for dynamic and precisely controlled adjustment of the position of the ramp assembly 80, thereby enabling customized variations of the resistance and the level of exercise provided by the elliptical exercise machine 100. According to one embodiment, the relative height of the lift mechanism in a low position is less than the fixed height of the fulcrum member 75, and a relative height of the lift mechanism in a raised position is greater than the fixed height of the fulcrum member 75. According to this embodiment, since the lift mechanism 70 may be actuated, as illustrated by the arrow M, to raise above or below the height of the fulcrum member 75, the ramp assembly may be oriented in either a positive or negative angular orientation relative to the base support structure 8.

Figure 9:
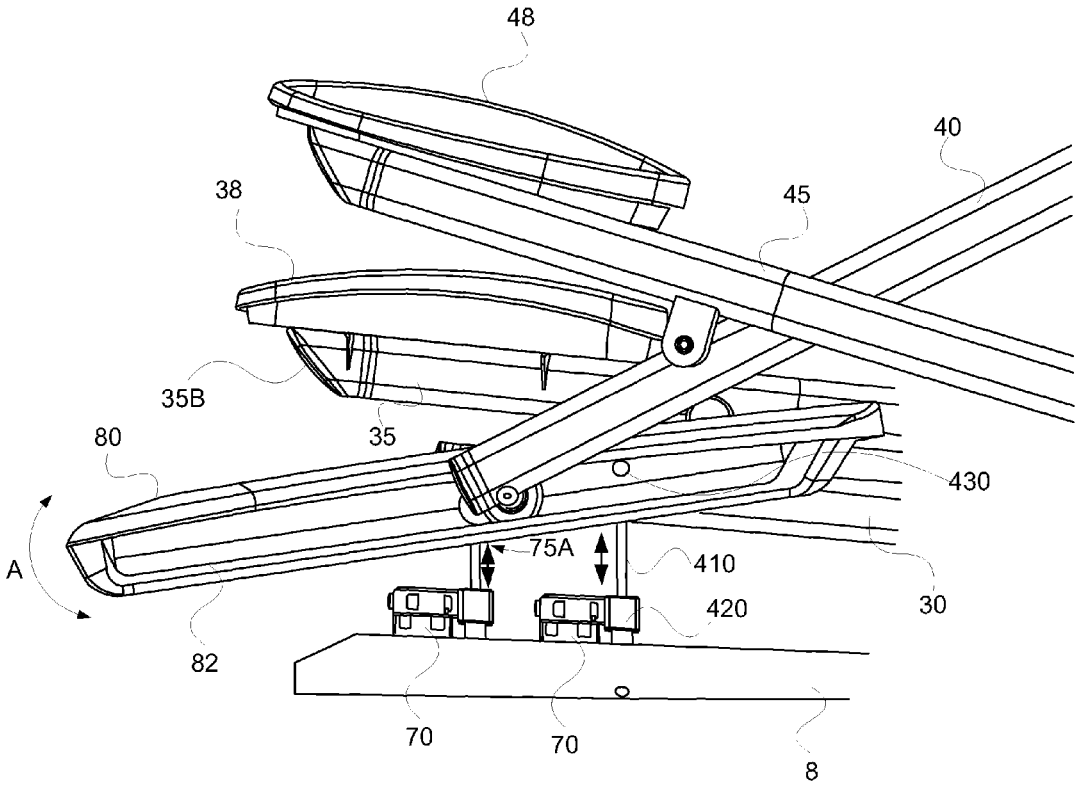
FIG. 9 illustrates a perspective view of the lift adjustment mechanism of the exercise machine of FIG. 1 having 2 actuators, according to one alternative embodiment.

Additionally, according to an alternative embodiment illustrated in FIG. 9, the fulcrum member 75 of the present embodiment may be replaced by a second lift mechanism 70. According to this embodiment, the ability to adjust the relative height of two points of the ramp assembly 80 allows for a maximized freedom of angular orientation. The actuators 70 each make a different connection point with the ramp assembly 80, at least one of the connection points being in the central region of the ramp assembly. The difference in height of each connection point, relative to the other connection point, will determine the angular orientation of the ramp assembly 80.

Similar to FIG. 4, FIG. 5 illustrates an exploded view of the adjustment mechanism relative to the base support structure 8 and the ramp assembly 80. As illustrated according to the embodiments in FIGS. 4 and 5, the fulcrum member 75 is fixedly attached to the base support structure 8 and rotatably engages the ramp assembly 80, forming the pivot point 75A. As shown in FIG. 5, the pivot point 75A is formed by the rotational mating of the fulcrum apex 500 and the fulcrum reception feature 510 defined by the ramp assembly 80. According to one embodiment, the fulcrum apex 500 may be pivotably pinned to the fulcrum reception feature 510 using any number of mechanical or chemical processes. As further illustrated, the fulcrum apex 500 pivotably engages the ramp assembly 80 at the centerline C of the ramp assembly. While the present system and method are described as having the fulcrum apex 500 engage the centerline C of the ramp assembly 80, the present system and method may be practiced by pivotably coupling the fulcrum apex 500 anywhere within the central region of the ramp assembly, as defined herein.

Formation of the pivot point 75A establishes a first point of contact for the support and controlled orientation of the ramp assembly 80. Similarly, the lift mechanism 70 is attached to the base support structure 8 and a point on the ramp assembly 80. As shown, the lift mechanism 70 is disposed on the base support structure 8 on the frontal side of the fulcrum member 75. However, relative positioning of the fulcrum member 75 and the lift mechanism 70 may be reversed, as will be discussed further below with reference to FIG. 8.

Although several types of lift mechanisms including, but in no way limited to linear and non-linear actuators, as well as other translational mechanisms could be incorporated by the present system and method for the selective actuation of the ramp assembly 80 of the present exercise machine 100, the lift mechanism 70, according to one embodiment, is a lead screw motor. Alternatively, the lift mechanism 70 may be any one of a hydraulic actuator, an electric actuator, a mechanical actuator, and the like. The lift mechanism 70 also is referred to as an extension motor, although it retracts as well as extends, i.e., lowers and raises the height of the ramp assembly 80. According to one embodiment, the lift mechanism 70 is configured to impart both a positioning force (imparts force to move the ramp assembly 80) and a maintenance force (maintains the relative position of the ramp assembly 8 during operation). As shown in FIG. 5, the lift mechanism 70 includes an actuator 420 that extends and retracts a rod 410 having a ramp engagement feature 530 formed on the end thereof. The ramp engagement feature 530 supports a corresponding rod reception feature 520 formed in the ramp assembly 80 completing a stable four-bar kinematic structure to support the ramp assembly (base support structure 8, fulcrum member 47, ramp assembly 80, and lift mechanism).

As illustrated in the FIGS, the rearward end 89 of the ramp assembly 80 does not contact the support surface 99 when the ramp 80 moves up and down according to the wishes of the user, i.e., when the user changes the level of exercise. Consequently, there is no likelihood of damage to a user's floor from repositioning of the ramp assembly 80. Additionally, in contrast to traditional elliptical apparatus that include a repositioning ramp that rolls along a support surface as it varies its relative position, the present system adds stability because the base and all contacts with the support surface are maintained.

Figure 6:
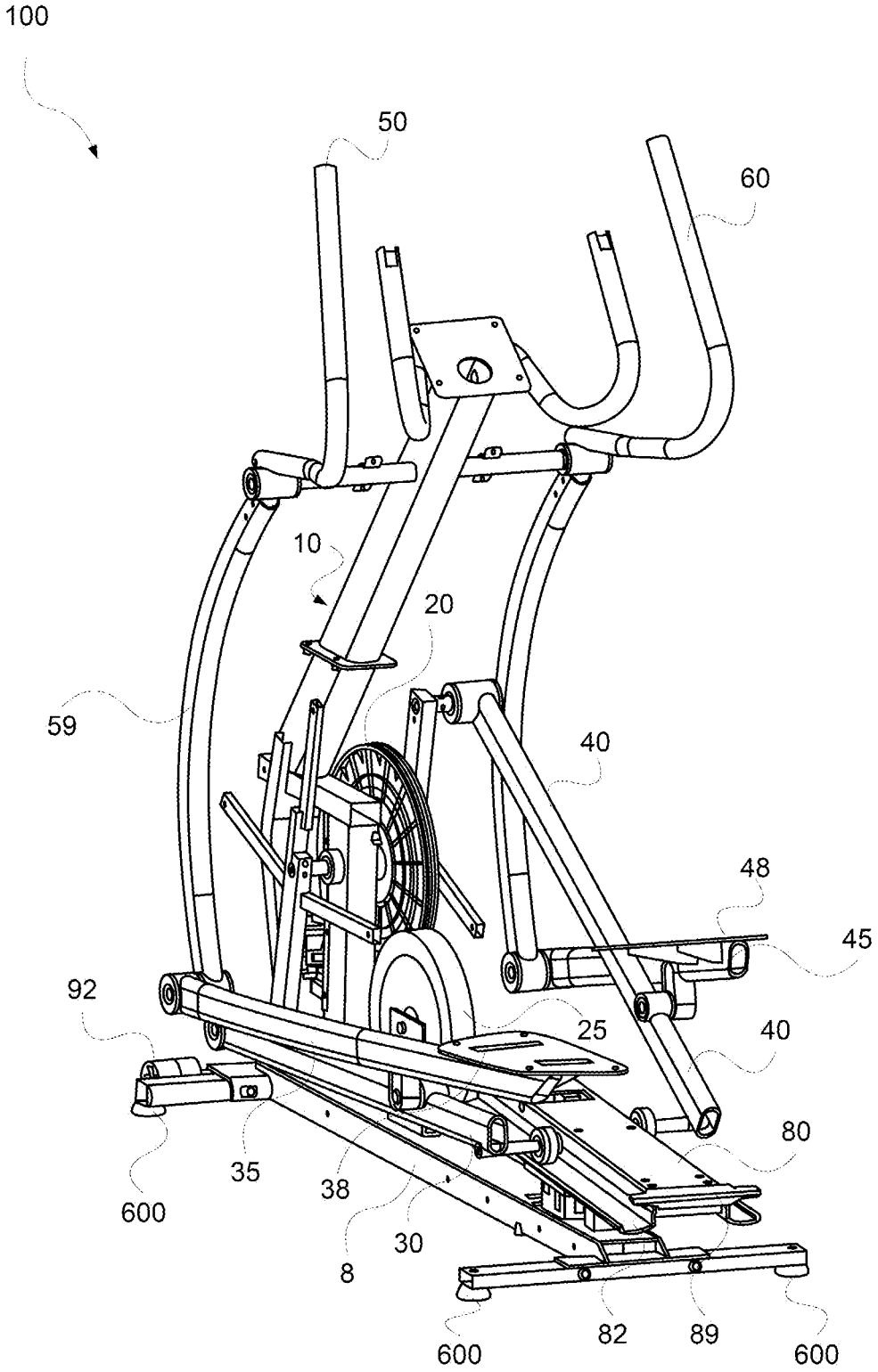
FIG. 6 illustrates another perspective view of the elliptical exercise machine of FIG. 1, according to one embodiment.

FIG. 6 illustrates a perspective view of the elliptical machine of FIG. 1. As shown, the base support structure 8 further comprises stabilizer legs and feet 600 protruding laterally from the base support structure. The elliptical exercise machine 100 further comprises wheels 92 and 94. Accordingly, a user can tilt the entire machine 100 forward, balancing it on its wheels 92 and 94 and roll the elliptical exercise machine 100 to any desired location. As shown in FIG. 6, the drive assembly 20 is mounted on an upright support structure serving as an extension to the base support structure. However, the drive assembly 20 may be supported and mounted on other features of the present elliptical exercise machine 100. The elliptical exercise machine 100 also includes a resistance assembly 25, which is mounted on the base support structure 8. As known, the use of an additional resistance assembly 25 is another way in which the user can change the level of exercise, i.e., by selecting the resistance level experienced during operation.

Figure 7:
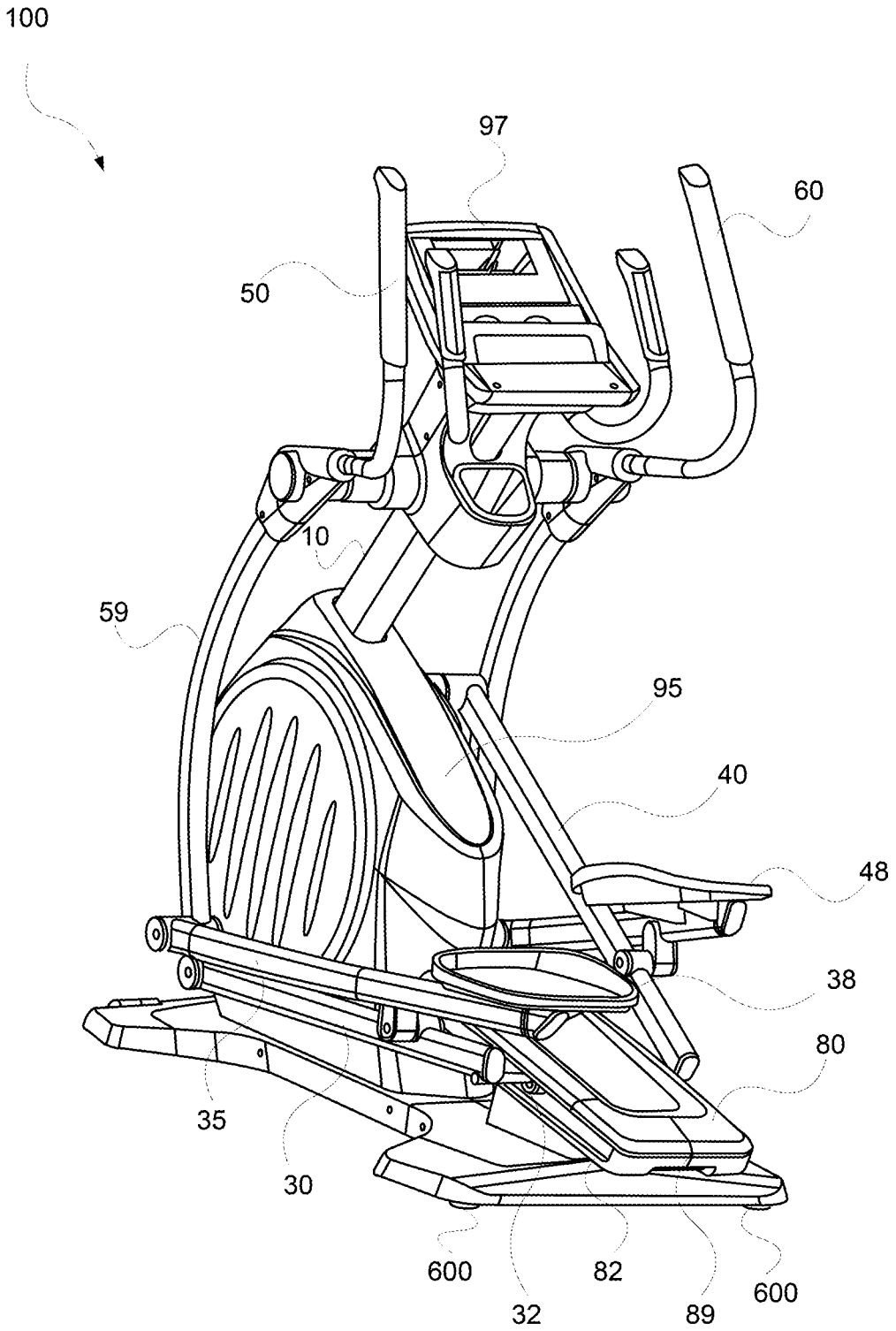
FIG. 7 illustrates a perspective view of the elliptical exercise machine of FIG. 6 including a number of housings installed, according to one embodiment.

FIG. 7 shows another perspective view of the elliptical machine 100 of FIG. 1. Specifically, according to one embodiment, FIG. 7 shows the elliptical exercise machine 100 as it looks in its "finished" state for sale to a consumer. That is, as shown in FIG. 7, a housing 95 is in place so that much of the inner workings described in the previous figures are not visible or accessible.

Figure 8:
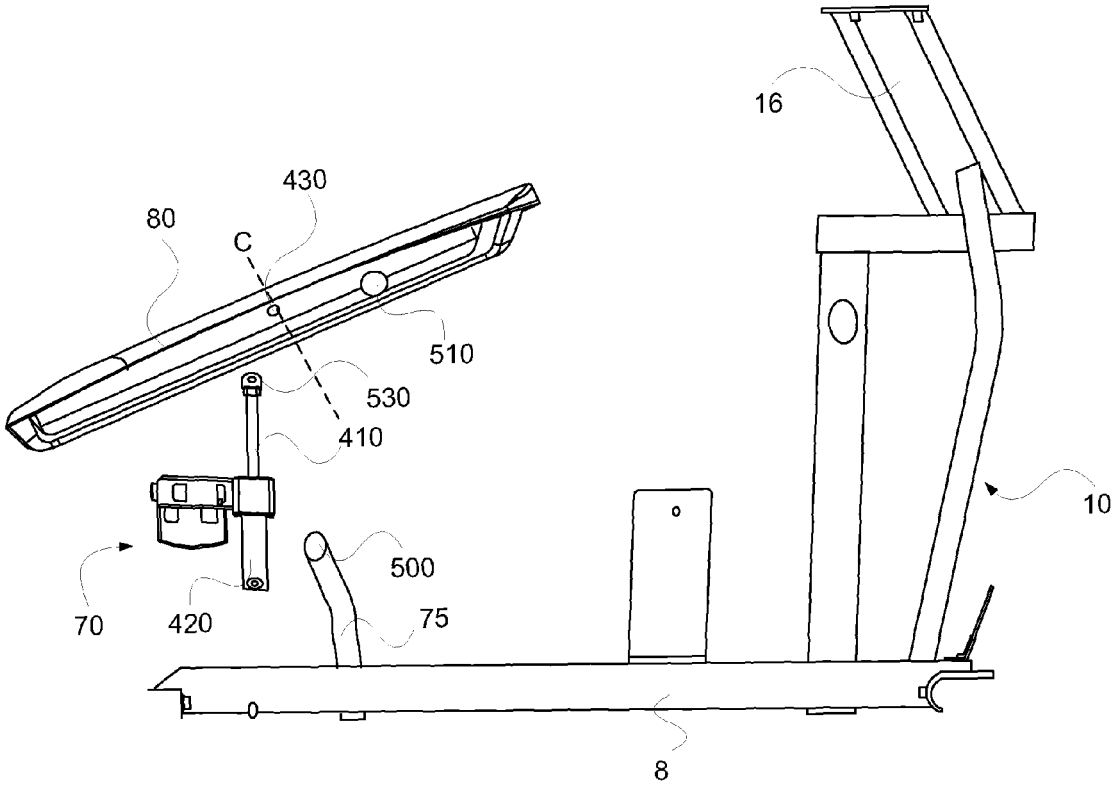
FIG. 8 illustrates an isolated view of alternative lift adjustment configuration, according to one alternative embodiment.

FIG. 8 illustrates an exploded side view of an alternative elliptical exercise machine configuration of the present systems and methods. Specifically, when referring to FIG. 5, the lift mechanism 40 is described as being in front of the fulcrum member 75. Alternatively, as illustrated in FIG. 8, the relative positions of the lift mechanism and the fulcrum member 75 may be reversed or repositioned to achieve a desired operability. That is, the location of the rod reception feature 430 and the fulcrum reception feature 510, as well as the lengths of the rod 410 and the fulcrum member 75, may be modified relative to one another and relative to the centerline C of the ramp assembly to vary the angular capabilities of the adjustment mechanism.

Figure 10A:
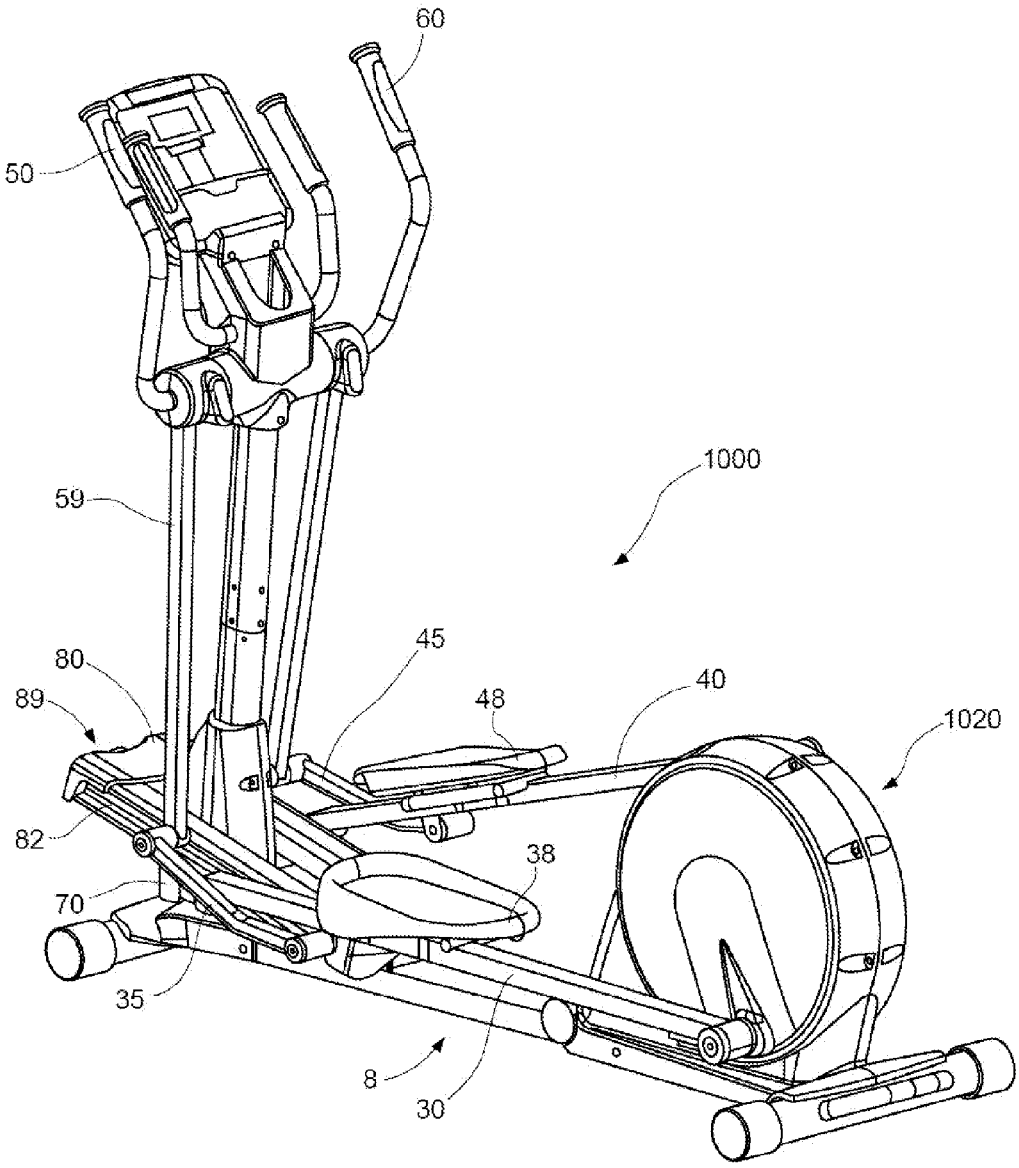
FIG. 10A illustrates a perspective view of a rear driven elliptical exercise machine including an adjustable ramp, according to one embodiment.
Figure 10B:
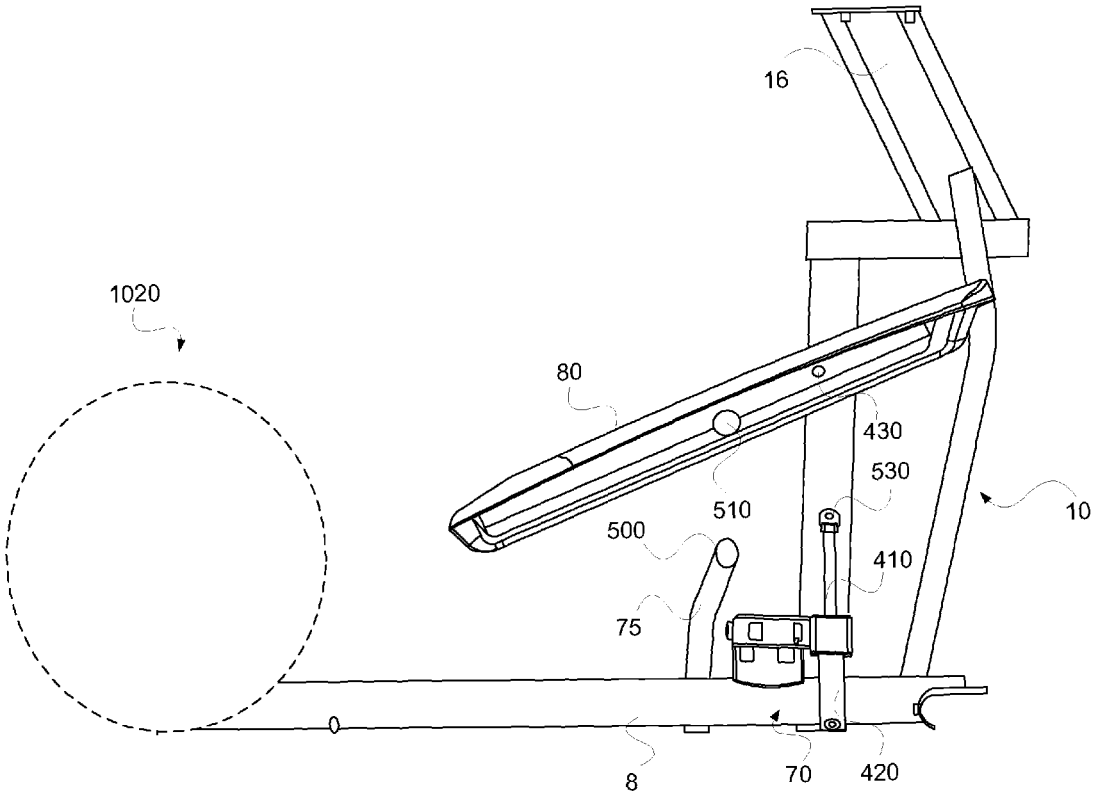
FIG. 10B illustrates an exploded perspective view of the lift adjustment mechanism of the exercise machine of FIG. 10A, according to one embodiment.

Similarly, while the present system and method are illustrated as having a drive assembly on the front portion of the apparatus and the ramp assembly on the rear of the apparatus, the respective positions of these features may be reversed or varied. For example, as illustrated in FIGS. 10A and 10B, the present system and method may be incorporated into a rear driven elliptical exercise machine 1000. As illustrated, the ramp assembly 80 and the lift mechanism 70 and associated fulcrum member 75 (not shown) are positioned on the front portion of the base support structure 8. According to this embodiment, a drive assembly 1020 is formed on the back portion of the base support structure 8 and the resistance and course simulation is performed by selective orientation of the ramp assembly 80 in positive and negative angular orientations relative to the base support structure 8. While transposing the ramp assembly 80 and the drive assembly 1020 can be performed according to FIGS. 10A and 10B, in this embodiment the ramp assembly may straddle the front structural elements of the elliptical exercise machine 1000. According to one embodiment, a plurality of synchronized lift mechanisms 70 may be employed to provide positioning and support of the ramp assembly 80 on both sides of the frame.

INDUSTRIAL APPLICABILITY

In order to motivate a user to continue pushing themselves and to enjoy their workout, it is desired to have an elliptical machine that can readily vary the level of resistance and angle of operation to more closely follow an anticipated and perceived resistance corresponding to a synthesized workout course or terrain.

In general, the structure of the present disclosure provides an elliptical exercise machine that allows the user to adjust the level of exercise with the press of a button or with variations that correspond to a programmed course.

Selection of a button on a console of the present system can provide commands to the present system such that the system varies the height of the ramp assembly to change the elliptical path for the user. That is, a more vertical elliptical path causes the user to undergo a more strenuous level of exercise than when the ramp assembly is oriented in a lower angular position. Particularly, the present system and method provide for a stable orientation of the ramp assembly such that it has a negative angular position relative to the base support structure. This ability to widely vary the angular orientation of the ramp assembly increases the resistance possibilities for a user and makes it possible for the controller to dynamically modify the angular position of the ramp assembly (and consequently the difficulty of operating the machine) to correspond with a known course. For example, according to one embodiment, the console may be equipped to link to Google Maps® and download the elevations along a known course or route. With the ability to provide both positive and negative angular positioning of the ramp assembly, the controller may provide instructions such that the angular position changes during a workout to more closely correspond to the ease and difficulty associated with the known course elevations. This will more closely simulate an actual course and will motivate the user to continue their workout.

Figure 12:
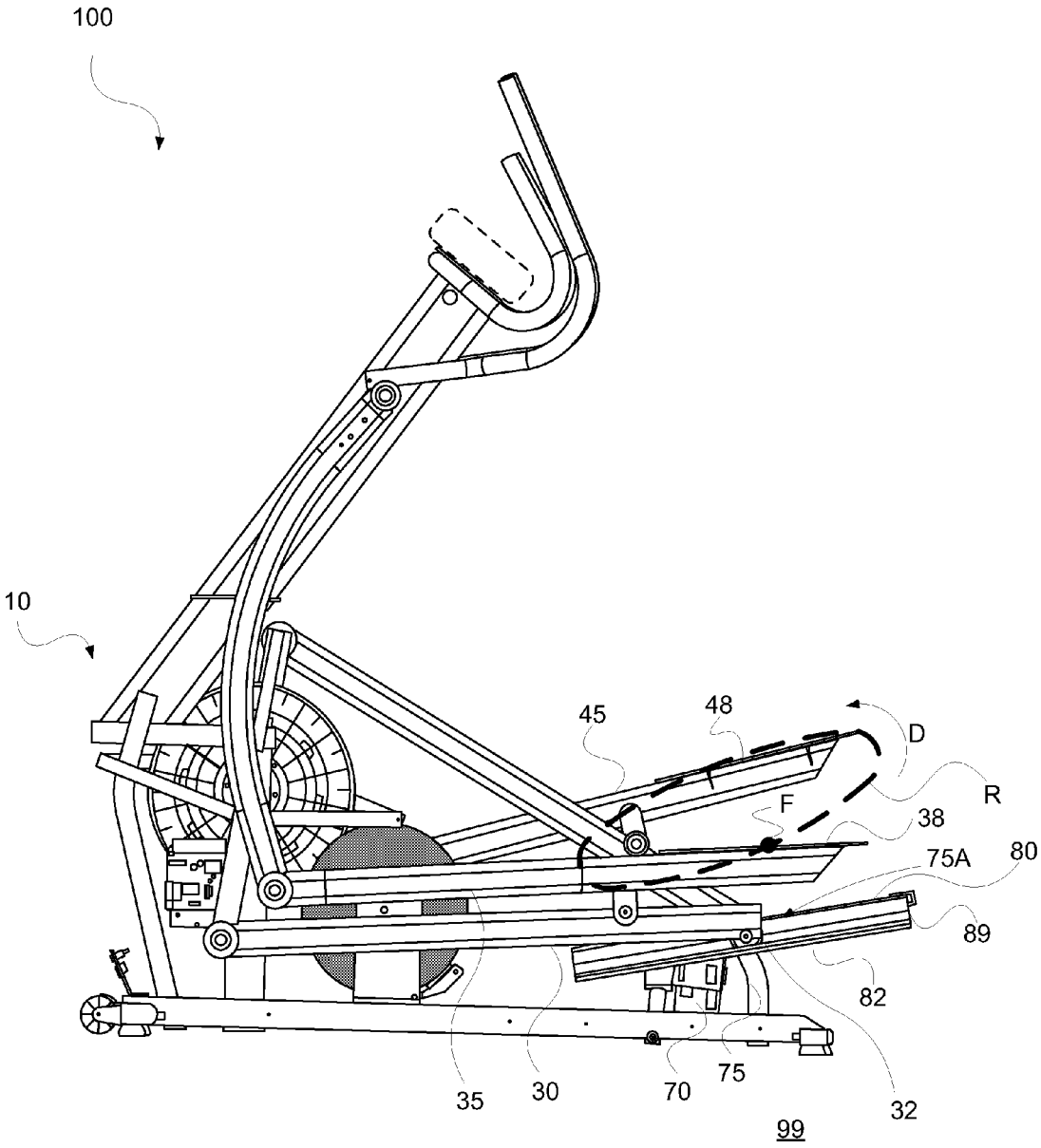
FIG. 12 illustrates a side view of the elliptical exercise machine of FIG. 1 demonstrating the foot path created by a negative ramp orientation, according to one embodiment.

In addition, the ability to provide negative angular orientations of the ramp in some configurations permits the elliptical exercise machine to simulate downhill walking, jogging, and running and thus, better exercise the stabilizer muscles, including the hamstrings, of users. Americans generally avoid downhill workouts, due in part to a dislike of the increased impact that is caused by many downhill exercises. As a consequence of the general avoidance of downhill workouts, Americans have a higher propensity for relatively underdeveloped of hamstrings and stabilizer muscles. However, the present system and method provides for a low-impact workout that exercises a user's hamstrings and other stabilizer muscles. Specifically, as illustrated in FIG. 12, when the ramp assembly 80 is positioned at a negative angular orientation relative to the horizontal support surface 99, the negative angular position of the ramp assembly will modify both the path and resistance provided as the foot placement pads 38, 48 are actuated by a user. FIG. 12 illustrates a route R traversed by a foot placement point F on one of the foot placement pads 38, 48 when the elliptical exercise machine 100 is operated with the ramp assembly 80 in a negative angular orientation. As illustrated, during operation, the foot placement point F follows a route R in the counter clockwise direction D. As shown, orienting the ramp assembly 80 in a negative angular orientation causes a user to experience a downward and forward directional foot placement, thereby incorporating a number of previously unused stabilizer muscles, including the user's hamstring muscles.

Generally, the present system and method also provides for varying the elliptical path of a plurality of foot placement pads while maintaining a stable base. Specifically, the present system and method elevates the ramp assembly above the support surface and orients the ramp assembly over the base support structure. Consequently, regardless of the angular positioning of the ramp assembly, the stability of the elliptical exercise machine is maintained. The angular variation of the ramp is achieved in one embodiment by supporting the ramp at two or more points, wherein at least one point of the ramp is pivotably supported by a lift mechanism configured to controllably position the ramp. The lift mechanism may be any number of linear or non-linear actuators or other positioning apparatuses including, but in no way limited to a lead screw motor, a hydraulic actuator, a worm gear actuator, a manual actuator, a pneumatic actuator, and the like. Additionally, as noted previously, more than one of the two or more ramp supports may be lift mechanisms. Furthermore, the present system may be incorporated on an elliptical exercise device having a drive assembly on either the front end or back end of the device.

In conclusion, the present system and method provides for an elliptical exercise machine with controllably variable exercise conditions. More specifically, a plurality of foot placement pads are linked with a compact exercise system that enables the performance of multiple exercises by maximizing the user's positioning options. Specifically, the present system provides an elliptical exercise machine having a ramp assembly to which is attached foot placement pads and reciprocating foot supports. The ramp assembly is configured to support and guide the reciprocating foot supports according to various selective and dynamically achievable positive and negative angles relative to the base frame of the exercise apparatus. By rotatably supporting the ramp assembly, having a Taylor factor between 0 and 2, at a central region with a fulcrum member and at a second point with a lift mechanism, both positive and negative angular orientations are achievable.

What is claimed is:

1. An elliptical exercise machine comprising:

a base support structure adapted to be positioned on a support surface;

first and second reciprocating foot supports, each foot support having a first end and a second end, the first end of each foot support being movably linked to the base support structure;

a first support member linked to the base support structure;

a ramp assembly pivotally attached to the first support member, the ramp assembly having first and second guide rails for guiding the respective second ends of the first and second foot supports such that the foot supports are moveable in an elliptical path, wherein a fulcrum member is pivotably linked to the ramp assembly at a point above the base support structure; and a second support member having a first end linked to the base support structure and a second end pivotally attached to the ramp assembly at a point above the base support structure;

wherein said second support structure comprises a lift mechanism.

2. The elliptical exercise machine of claim 1, wherein the first support member is pivotably attached to the ramp assembly in a central region of the ramp assembly.

3. The elliptical exercise machine of claim 1, wherein said first support member comprises the fulcrum member.

4. The elliptical exercise machine of claim 1, further comprising a drive assembly situated on a front portion of the elliptical exercise machine, the first end of each foot support being linked to the drive assembly such that the first end of each foot support is movably linked to the base support structure.

5. The elliptical exercise machine of claim 1 further comprising an upright support structure extending upward from the front portion of the base support structure.

6. The elliptical exercise machine of claim 1, wherein the lift mechanism is positionable in both a low and a high orientation;

wherein the low orientation of the lift mechanism creates a connection point on the ramp assembly that is lower than a height of the first support member and the high orientation of the lift mechanism creates a connection point that is higher than a height of the first support member.

7. The elliptical exercise machine of claim 1, wherein the lift mechanism and the first support member each comprise an actuator.

8. The elliptical exercise machine of claim 6, wherein the lift mechanism and the first support member are configured to selectively orient the ramp assembly in a positive angular orientation and a negative angular orientation relative to and positionally above the base support structure.

9. The elliptical exercise machine of claim 8 further comprising first and second swing arms, each arm having an upper portion and a lower portion, the upper portion of each arm being pivotally connected to the upright support structure, the lower portion of each arm being interconnected to the respective first and second foot supports.

10. The elliptical exercise machine of claim 9, further comprising first and second link arms, each link arm having a first end and a second end, wherein the lower portion of each swing arm is pivotally connected to the first end of each respective link arm and the second end of each respective link arm is connected to the respective first and second foot supports.

11. The elliptical exercise machine of claim 10, wherein each swing arm is pivotally connected to the first end of each respective link arm at the lower end of the lower portion of each swing arm.

12. The elliptical exercise machine of claim 8, wherein the lift mechanism and the first support member are configured to selectively orient the ramp assembly in a positive angular orientation of at least +20degrees relative to horizontal and a negative angular orientation of at least −10degrees relative to horizontal.

13. The elliptical exercise machine of claim 8, wherein the first support member and the lift mechanism are both rotatably linked to the ramp assembly in the central region of the ramp assembly.

14. The elliptical exercise machine of claim 1, further comprising a console configured to transmit commands to the lift mechanism configured to actuate the lift mechanism to selectively position an angular orientation of the ramp assembly.

15. An elliptical exercise machine comprising:

a base support structure adapted to be positioned on a support surface;

an upright support structure extending upward from the front portion of the base support structure;

first and second reciprocating foot supports, each foot support having a first end and a second end, the first end of each foot support being movably linked to the base support structure;

a drive assembly situated on the front portion of the base support structure, the first end of each foot support being linked to the drive assembly such that the first end of each foot support is movably linked to the base support structure;

first and second swing arms, each arm having an upper portion and a lower portion, the upper portion of each arm being pivotally connected to the upright support structure, the lower portion of each arm being interconnected to the respective first and second foot supports;

first and second link arms, each link arm having a first end and a second end, wherein the lower portion of each swing arm is pivotally connected to the first end of each respective link arm and the second end of each respective link arm is connected to the respective first and second foot supports, wherein each swing arm is pivotally connected to the first end of each respective link arm at the lower end of the lower portion of each swing arm;

a first support member pivotably linked to the base support structure in a central region of the ramp assembly;

a ramp assembly pivotally attached to the first support member, the ramp assembly having first and second guide rails for guiding the respective second ends of the first and second foot supports such that the foot supports are moveable in an elliptical path, wherein a fulcrum member is pivotably linked to the ramp assembly at a point above the base support structure; and a second support member having a first end linked to the base support structure and a second end pivotally attached to the ramp assembly at a point above the base support structure;

wherein said second support structure comprises a lift mechanism;

wherein the lift mechanism and the first support member are configured to selectively orient the ramp assembly in a positive angular orientation and a negative angular orientation relative to the base support structure;

wherein said ramp assembly exhibits a Taylor factor between 0 and 2.

16. The elliptical exercise machine of claim 15, wherein the lift mechanism and the first support member each comprise linear actuators.

17. The elliptical exercise machine of claim 15, wherein the lift mechanism and the first support member are configured to selectively orient the ramp assembly in a positive angular orientation of at least +20 degrees relative to horizontal and a negative angular orientation of at least −10 degrees relative to horizontal.

18. The elliptical exercise machine of claim 15, wherein both the first support member and the lift mechanism are each rotatably linked to the ramp assembly in a central region of the ramp assembly.

19. The elliptical exercise machine of claim 15, wherein said ramp assembly exhibits a Taylor factor between 0 and 1.2.

20. An elliptical exercise machine comprising:

a base support structure adapted to be positioned on a support surface;

an upright support structure extending upward from the front portion of the base support structure;

first and second reciprocating foot supports, each foot support having a first end and a second end, the first end of each foot support being movably linked to the base support structure;

a drive assembly situated on the front portion of the base support structure, the first end of each foot support being linked to the drive assembly such that the first end of each foot support is movably linked to the base support structure;

first and second swing arms, each arm having an upper portion and a lower portion, the upper portion of each arm being pivotally connected to the upright support structure, the lower portion of each arm being interconnected to the respective first and second foot supports;

first and second link arms, each link arm having a first end and a second end, wherein the lower portion of each swing arm is pivotally connected to the first end of each respective link arm and the second end of each respective link arm is connected to the respective first and second foot supports, wherein each swing arm is pivotally connected to the first end of each respective link arm at the lower end of the lower portion of each swing arm;

a first support member pivotably linked to the base support structure in a central region of the ramp assembly;

a ramp assembly pivotally attached to the first support member, the ramp assembly having first and second guide rails for guiding the respective second ends of the first and second foot supports such that the foot supports are moveable in an elliptical path, wherein a fulcrum member is pivotably linked to the ramp assembly at a point above the base support structure; and a second support member having a first end linked to the base support structure and a second end pivotally attached to the ramp assembly at a point above the base support structure;

wherein said second support structure comprises a lift mechanism;

wherein the lift mechanism and the first support member are configured to selectively orient the ramp assembly in a positive angular orientation and a negative angular orientation relative to the base support structure;

wherein the lift mechanism and the first support member are configured to selectively orient the ramp assembly in a positive angular orientation of at least +20 degrees relative to horizontal and a negative angular orientation of at least −10 degrees relative to horizontal;

wherein both the first support member and the lift mechanism are each rotatably linked to the ramp assembly in a central region of the ramp assembly; and wherein said ramp assembly exhibits a Taylor factor between 0 and 2.

* * * * *